US011227708B2

(12) United States Patent
Clement et al.

(10) Patent No.: US 11,227,708 B2
(45) Date of Patent: Jan. 18, 2022

(54) MOISTURE SEAL FOR HIGH VOLTAGE INSULATOR

(71) Applicant: Marmon Utility, LLC, Milford, NH (US)

(72) Inventors: Charles Clement, Milford, NH (US); Guberson Mercedat, Milford, NH (US); Gary Grenier, Milford, NH (US)

(73) Assignee: Marmon Utility LLC, Milford, NH (US)

( * ) Notice: Subject to any disclaimer, the term of this patent is extended or adjusted under 35 U.S.C. 154(b) by 159 days.

(21) Appl. No.: 16/522,040

(22) Filed: Jul. 25, 2019

(65) Prior Publication Data

US 2021/0027920 A1 Jan. 28, 2021

(51) Int. Cl.

| | |
|---|---|
| ***H01B 17/30*** | (2006.01) |
| ***H01B 17/32*** | (2006.01) |
| ***H01B 3/30*** | (2006.01) |
| ***H01B 17/38*** | (2006.01) |

(52) U.S. Cl.

CPC ..... *H01B 17/325* (2013.01); *H01B 3/30* (2013.01); *H01B 17/38* (2013.01)

(58) Field of Classification Search

CPC ..... H01B 17/325; H01B 17/38; H01B 17/40; H01B 3/30; H01B 7/046; H01B 17/005; H01B 17/32; H01B 17/36; H01R 12/714; H01R 12/716; H01R 12/722; H01R 12/724; H01R 13/187; H01R 13/53; H01R 13/533

USPC ..... 174/179

See application file for complete search history.

(56) References Cited

U.S. PATENT DOCUMENTS

| | | | | |
|---|---|---|---|---|
| 2,191,152 A * | 2/1940 | Hammel | H01B 17/40 | 174/140 R |
| 3,735,019 A * | 5/1973 | Hess | H01H 33/56 | 174/31 R |
| 3,878,321 A * | 4/1975 | Ely | H01B 17/42 | 174/144 |
| 4,373,113 A * | 2/1983 | Winkler | B29C 45/14549 | 174/179 |
| 4,604,498 A | 8/1986 | Kuhl | | |

(Continued)

FOREIGN PATENT DOCUMENTS

| | | |
|---|---|---|
| CN | 201387771 Y | 1/2010 |
| CN | 202230808 U | 5/2012 |
| GB | 1292276 A | 10/1972 |

OTHER PUBLICATIONS

International Search Report issued by ISA/EPO in connection with PCT/US2020/043728 dated Sep. 24, 2020.

(Continued)

*Primary Examiner* — Krystal Robinson

(74) *Attorney, Agent, or Firm* — Levenfeld Pearlstein, LLC

(57) ABSTRACT

High voltage insulators are disclosed, along with related methods of manufacture and use. The disclosed high voltage insulators include a core strength member joined to one or more end fittings and secured with one or more elastomeric members. A plastic body surrounds the core strength member, the elastomeric member, and at least a portion of the end fitting. In particular, the plastic body is molded over the elastomeric member(s) and, upon cooling, the plastic body exerts a radial compressive force on the underlying elastomeric member(s) to seal the joint of the high voltage insulator and protect it from moisture, even throughout temperature fluctuations in the field.

15 Claims, 10 Drawing Sheets

(56) References Cited

U.S. PATENT DOCUMENTS

| | | | | |
|---|---|---|---|---|
| 4,724,284 | A | 2/1988 | Wheeler | |
| 5,220,134 | A * | 6/1993 | Novel | H01B 17/02 174/169 |
| 5,374,789 | A | 12/1994 | Bernstorf | |
| 6,657,128 | B2 | 12/2003 | Ramarge et al. | |
| 7,180,003 | B2 | 2/2007 | Almgren et al. | |
| 7,709,743 | B2 | 5/2010 | Bernstorf et al. | |
| 7,964,799 | B2 | 6/2011 | Isberg et al. | |
| 7,989,704 | B2 | 8/2011 | Bessede et al. | |
| 8,003,891 | B2 | 8/2011 | Rocks et al. | |
| 8,278,557 | B2 | 10/2012 | Widmer et al. | |
| 8,426,736 | B2 | 4/2013 | Hyde et al. | |
| 9,322,737 | B2 | 4/2016 | Holmberg et al. | |
| 9,601,240 | B2 | 3/2017 | Hoefner | |
| 9,649,797 | B1 | 5/2017 | Williams et al. | |
| 2004/0001298 | A1 * | 1/2004 | Henricks | H01B 17/325 361/118 |
| 2005/0034892 | A1 * | 2/2005 | Philips | H01B 17/325 174/137 A |
| 2012/0012364 | A1 | 1/2012 | Grenier | |
| 2014/0054063 | A1 * | 2/2014 | George | H01B 13/14 174/137 B |

OTHER PUBLICATIONS

Written Opinion issued by ISA/EPO in connection with PCT/US2020/043728 dated Sep. 24, 2020.

* cited by examiner

MOISTURE SEAL FOR HIGH VOLTAGE INSULATOR

FIELD

The present disclosure relates, generally, to overhead distribution and transmission insulators and, more particularly, relates to high voltage electrical insulators and related methods of manufacture.

BACKGROUND

Insulators are used with electrical transmission and distribution systems to isolate and support electrical conductors above the ground for overhead power distribution and transmission. In power distribution systems, the most common insulator types are Pin-type and Post type (Line post and Station post) insulators mounted on wood cross-arms or metal brackets to mechanically support the line conductors. These insulators are primarily designed for static loads but may be subject to dynamic loads, such as wind induced vibrating conductors or heavy objects falling on the line such as tree branches; therefore, they must withstand complex loads with compressive, cantilever, tensile and rotational force components. Pin-type insulators were developed in the nineteenth century and are still commonly applied to circuits today. As electrical networks and loads grew, with higher voltage systems and larger conductors, post-type insulators were developed to better support these systems.

Traditional manufacturing of these Post type insulators is based on the wet-process porcelain process, also known as ceramics, by forming a body and cementing it to at least one ductile metal end-fitting. It is widely employed today to produce cost-effective insulators. Non-ceramic insulator manufacturing, also known as polymer or composite, was developed in the 1960's to overcome the high-weight and poor impact resistance characteristics of ceramics. The non-ceramic post insulators are comprised of metal end-fittings, a fiberglass core strength member and an outer weathershed, typically of elastomeric or polymeric material. The fiberglass core provides mechanical strength sufficient to support high-voltage electrical conductors in both vertical and horizontal mounting configurations. Current manufacturing methods permanently attach the metal end-fittings to the core, most commonly by a mechanical compression method known as crimping or swaging.

Other approaches have used a molded plastic to cover the fiberglass core and secure the metal end-fittings. However, these designs are susceptible to moisture infiltration over time, making the joints at a higher risk for failure. Under high electrical stress, the air ionizes and reacts with the moisture to form acids. These acids break down the fiberglass over time and cause a mechanical failure of the insulator. Adhesives or room-temperature-volcanizing (RTV) Silicone can be used to temporarily address this moisture infiltration issue but cannot survive the long term expansion and contraction cycles due to temperature changes. Accordingly, a new design for high voltage insulators is needed in which the connection of the core strength member and the metal end-fittings is resistant to moisture infiltration and is securely maintained through temperature changes.

SUMMARY

High voltage insulators are disclosed herein. In some embodiments the disclosed high voltage insulators include a rod-shaped core strength member, at least one end fitting having a base and a neck with an internal cavity configured to retain a portion of the core strength member, at least one elastomeric member positioned on an outer surface of the at least one end fitting, and a plastic body surrounding the core strength member, the at least one elastomeric member, and the neck of the at least one end fitting. In some such embodiments, the plastic body exerts a radial compressive force on the at least one underlying elastomeric member. The core strength member may be implemented with fiberglass and, in some embodiments, the plastic body may be implemented with a thermoplastic. If the plastic body is implemented with a thermoplastic, the thermoplastic may include one or more of: high density polyethylene (HDPE), linear low density polyethylene (LDPE), polypropylene, polyvinyl chloride (PVC), acrylonitrile butadiene styrene (ABS), acrylic (e.g., polymethyl methacrylate), polycarbonate, polyvinylidene fluoride (PVDF). The plastic body may include a plurality of fins, which may be positioned parallel to one another. The one or more elastomeric members may be formed of one or more of the following materials: rubber, silicone, polybutadiene, isoprene, neoprene, polychloroprene, butyl rubber, fluorosilicone, ethylene-vinyl acetate (EVA). In some embodiments, the one or more elastomeric members may be toroidally shaped and, in select embodiments, the one or more elastomeric members may each have a circular cross-section. The one or more end fittings may each be formed of a metal, in some embodiments. The neck of the one or more end fittings may include a channel formed in an outer surface of the end fitting to retain the elastomeric member. In these and other embodiments, the neck may also include a lip positioned next to the channel and farther away from the base than the channel. In some embodiments, the high voltage insulator includes one end fitting and one elastomeric member whereas, in other embodiments, the high voltage insulator includes two end fittings and two elastomeric members.

Methods of forming a high voltage insulator are also described herein. In some embodiments, a high voltage insulator is produced by joining a core strength member and one or more end fittings together, positioning one or more elastomeric members onto the one or more end fittings to form an assembly, molding a plastic body over the assembly such that the plastic body covers the core strength member, the one or more elastomeric members, and at least a portion of the one or more end fittings, and allowing the molded plastic body to cool to form the high voltage insulator with one or more elastomeric members that are continuously radially compressed by the surrounding plastic body. In some embodiments, the plastic body contracts at least 1% during cooling. In these and other embodiments, the one or more elastomeric members may each be positioned in a channel on an outer surface of the one or more end fittings.

BRIEF DESCRIPTION OF THE DRAWINGS

Many aspects of the disclosure can be better understood with reference to the following drawings. The components in the drawings are not necessarily to scale, emphasis instead being placed upon clearly illustrating the features of example embodiments. Moreover, in the drawings, like reference numerals designate corresponding parts throughout the several views.

FIG. 3A illustrates the complete high voltage insulator with two attached end fittings, FIG. 3B illustrates the first end fitting of the high voltage insulator.

FIG. 4A illustrates a perspective view of the high voltage insulator and FIG. 4B illustrates the high voltage insulator with a transparent plastic body.

FIG. 5A illustrates a perspective view of the high voltage insulator, FIG. 5B illustrates a cross-sectional view of the high voltage insulator, FIG. 5C illustrates a view of the high voltage insulator with a transparent plastic body, and FIG. 5D illustrates a cross-sectional view of the portion of the high voltage insulator at which the core strength member is joined to the end fitting.

DETAILED DESCRIPTION

Figure 1:
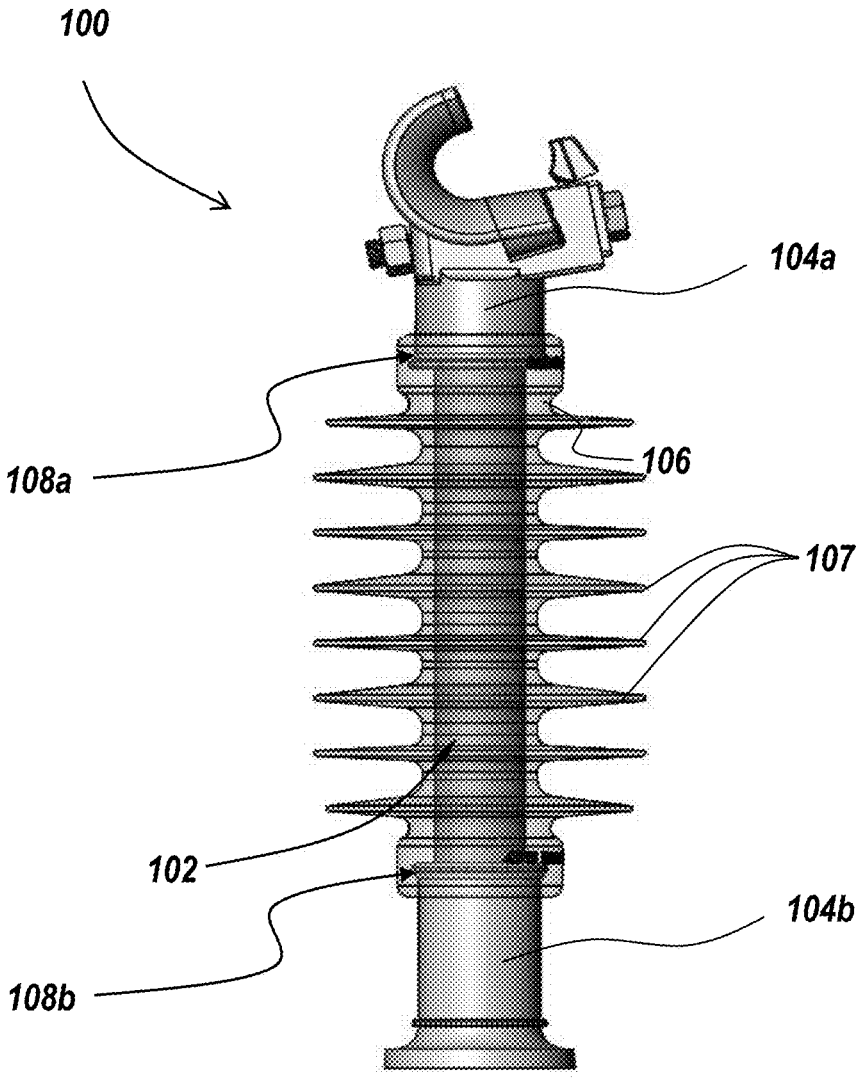
FIG. 1 illustrates an exemplary high voltage insulator configured in accordance with some embodiments of the subject disclosure.

The presently disclosed high voltage insulators address issues with previous insulator designs. Specifically, in the disclosed high voltage insulators, each end fitting secured to the core strength member is outfitted with an elastomeric member (e.g., an O-ring) and encased with an over-molded thermoplastic material. The thermoplastic material is molded into a body for the high voltage insulator, which covers the core strength member, the elastomeric member, and at least part of the end fitting. The thermoplastic material ultimately forms the plastic body of the high voltage insulator and can be shaped to include fins or sheds, as desired. As the thermoplastic cools, it shrinks and compresses the underlying elastomeric member(s), thereby forming a hermetic seal between the end fitting and the plastic body and protecting the core strength member.

Many other high voltage insulators use elastomeric materials as the outer plastic material and it is worth noting that these types of materials would not be well-suited for use with the elastomeric sealing members described herein since the outer elastomeric materials would not cure in a manner that permanently compresses the underlying elastomeric member. Also, although the presently disclosed elastomeric members include features similar to O-rings used for some other applications, the use of elastomeric members in high voltage insulators, as presently disclosed, is unique. For example, the O-rings used in plumbing, high pressure, or high vacuum applications require a mechanical force to constantly be applied to the partially collapse the O-ring to form a seal. However, in this particular new application, an elastomeric member is submitted to an external mechanical force from the thermal contraction and natural shrinkage of the outer thermoplastic resin surrounding a circumference of the end fitting and the elastomeric member. The radial compressive force exerted on the elastomeric member by the outer plastic body will keep the elastomeric member under compression at all times, despite extreme temperature variations in the field.

The disclosed high voltage insulators may be configured to accommodate and insulate any desired high voltage cable, such as aerial high voltage cables. In some embodiments, the disclosed high voltage insulators are suitable for use with 15 KV to 46 KV distribution cables, 69 kV sub-transmission cables and/or transmission cables adapted to carry a voltage greater than 69 kV, e.g. 115 kV, or 138 kV transmission cables.

Surprisingly, it has been found that certain elastomeric members are durable enough to survive injection molding pressures and temperatures used to manufacture high voltage insulators in accordance with the subject disclosure. It is also extremely advantageous that the disclosed devices and techniques can be used in various types of high voltage insulators, regardless of the method of attachment used to secure the end fitting(s) to the core strength member. For example, the disclosed high voltage insulators with one or more elastomeric members can be used in devices having over-molded plastic used to secure the core strength member to the end fitting(s) and/or a crimped-type connection between these components.

Particular structures of the disclosed high voltage insulators, as well as related methods of manufacture, are described in detail in the following sections.

Exemplary Structures

FIG. 1 illustrates an exemplary high voltage insulator 100. As shown in FIG. 1, the voltage insulator includes a central core strength member 102 connected to one or more end fittings 104*a*, 104*b*. In some embodiments, the core strength member 102 extends at least partially within the one or more end fittings 104*a*, 104*b*. A plastic body 106 surrounds the core strength member 102 and extends at least partially over features of the end fitting(s) 104*a*, 104*b*. As shown in FIG. 1, the plastic body 106 may be formed to include a plurality of spaced fins or sheds 107.

In contrast to previous insulator configurations, the currently disclosed high voltage insulators include one or more elastomeric members (108*a*, 108*b* in FIG. 1) positioned between each end fitting 104*a*, 104*b* and the plastic body 106. As will be appreciated upon consideration of the subject disclosure, the one or more elastomeric members may advantageously create a seal between the end fitting(s) and the plastic body to prevent water, ice, or debris from infiltrating between these components. In this way, the disclosed high voltage insulators have superior properties to those of the prior art without elastomeric members.

The core strength member 102 may be rod-shaped with either rounded or planar sides. In some embodiments, the core strength member 102 is implemented with fiberglass or another suitable material. The core strength member 102 may impart mechanical strength to the high voltage insulator 100, enabling the insulator 100 to successfully retain one or more conductors in a fixed position suspended from the ground.

The one or more end fittings 104*a*, 104*b* may be implemented with any appropriate type of material, such as a metal, metal alloy, composite, or non-metal composite. In some embodiments, the one or more end fittings 104*a*, 104*b* are formed of forged steel or a die-cast aluminum-silicon alloy. The end fitting(s) 104*a*, 104*b* may be shaped to retain the core strength member 102 and may also, in some embodiments, include features to connect to other structures, such as cables or conductors. Particular features of exemplary end fittings 104*a*, 104*b* are discussed in detail with respect to FIGS. 3B and 3C in the following paragraphs. The end fitting(s) 104*a*, 104*b* may be secured to the core strength member 102 using any suitable technique, such as crimping, adhesive, and/or encasement by the plastic body 106.

As shown in FIG. 1, the plastic body 106 of the high voltage insulator 106 is shaped to surround the core strength member 102 and at least part of the metal fitting(s) 104*a*, 104*b*. The plastic body 106 may be formed of any suitable polymer, such as a thermoplastic. In some embodiments, the plastic body 106 is implemented with a rigid polymer, such as high density polyethylene (HDPE), linear low density polyethylene (LDPE), polypropylene, polyvinyl chloride (PVC), acrylonitrile butadiene styrene (ABS), acrylic (e.g., polymethyl methacrylate), polycarbonate, polyvinylidene fluoride (PVDF), and/or combinations thereof. In embodiments in which one or more thermoplastics are used to form the plastic body 106, the thermoplastic(s) may shrink or contract as the plastic body 106 cools to cure. In some embodiments, the plastic body 106 may contract at least 1%, 2%, 5% or more during cooling.

The plastic body 106 may, in some embodiments, be molded directly over the core strength member 102 and over at least part of the metal fitting(s) 104*a*, 104*b*, for example, by over-molding. In some embodiments, the plastic body 106 is opaque, while in other embodiments, the plastic body 106 is partially or fully transparent. The plastic body 106 may include a plurality of fins or sheds 107, as shown in FIG. 1. Although in FIG. 1 the fins 107 are illustrated as being disposed parallel to one another, in some embodiments, the fins 107 may be non-parallel. Additionally, fins 107 may be disposed non-orthogonally or orthogonally to the core strength member 102. Numerous configurations and variations are possible and contemplated herein.

The presently disclosed high voltage insulators 100 also include one or more elastomeric members 108*a*, 108*b*, as shown in FIG. 1. In the disclosed high voltage insulators, each junction of the plastic body 106 with an end fitting (e.g., 104*a*, 104*b*) is sealed with an elastomeric member (e.g., 108*a*, 108*b*). FIG. 1 illustrates an exemplary high voltage insulator 100 with a first elastomeric member 108*a* positioned external to a first end fitting 104*a* and adjacent to the surrounding plastic body 106 and a second elastomeric member 108*b* positioned external to a second end fitting 104*b* and adjacent to the surrounding plastic body 106. As will be appreciated, the elastomeric members 108*a*, 108*b* present in the high voltage insulator may be compressed by the surrounding plastic body 106. The compressive force exerted by the plastic body 106 on the underlying elastomeric member(s) 108*a*, 108*b* is radially applied and causes the elastomeric member(s) to expand to fill any voids between the end fitting(s) 104*a*, 104*b* and the plastic body 106. Specifically, the radial compressive force of the plastic body 106 causes the elastomeric member(s) 108*a*, 108*b* to expand in a direction perpendicular to the force applied and to tightly seal the area between the directly adjacent end fitting and plastic body.

The elastomeric member(s) 108*a*, 108*b* may be toroidally shaped with either a rounded or an angular cross-section. In some embodiments, elastomeric members having a circular cross-section are used, whereas in other embodiments, elastomeric members having an oval-shaped, pentagonal, hexagonal, or octagonal cross-section are used. The elastomeric member(s) may be formed of any elastomeric material, such as rubber (natural or synthetic), silicone, polybutadiene, isoprene, neoprene, polychloroprene, butyl rubber (including halogenated butyl rubber), fluorosilicone, ethylene-vinyl acetate (EVA), and/or combinations thereof. The elastomeric member(s) 108*a*, 108*b* may be easily compressible and, in some embodiments, the elastomeric member(s) 108*a*, 108*b* may have a Shore hardness of between 1 and 100, between 5 and 75, between 10 and 40, or between 20 and 30. In these and other embodiments, the elastomeric member(s) 108*a*, 108*b* may have a Shore hardness that is less than the Shore hardness of the plastic body 106, meaning that the elastomeric member(s) 108*a*, 108*b* can expand and compress to a greater extent than the plastic body 106. As will be understood by those skilled in the art, Shore hardness can be measured according to standardized methods using a Shore durometer.

In some embodiments, the elastomeric member(s) 108*a*, 108 may be formed of a material having a coefficient of thermal expansion (CTE) three (3) to six (6) times greater than the material used to form the plastic body 106. In some such embodiments, the difference in CTE of the materials can allow the elastomeric member(s) 108*a*, 108*b* to permanently remain under compression within the plastic body 106, thereby providing the permanent seal. In some embodiments, the elastomeric members(s) 108*a*, 108*b* may have a CTE of between 5-10 $10^{-5}$/° C. or between 10-40 $10^{-5}$/° C. In these and other embodiments, the plastic body 106 may have a CTE of between 50-60 $10^{-5}$/° C. or between 70-100 $10^{-5}$/° C.

Figure 2:
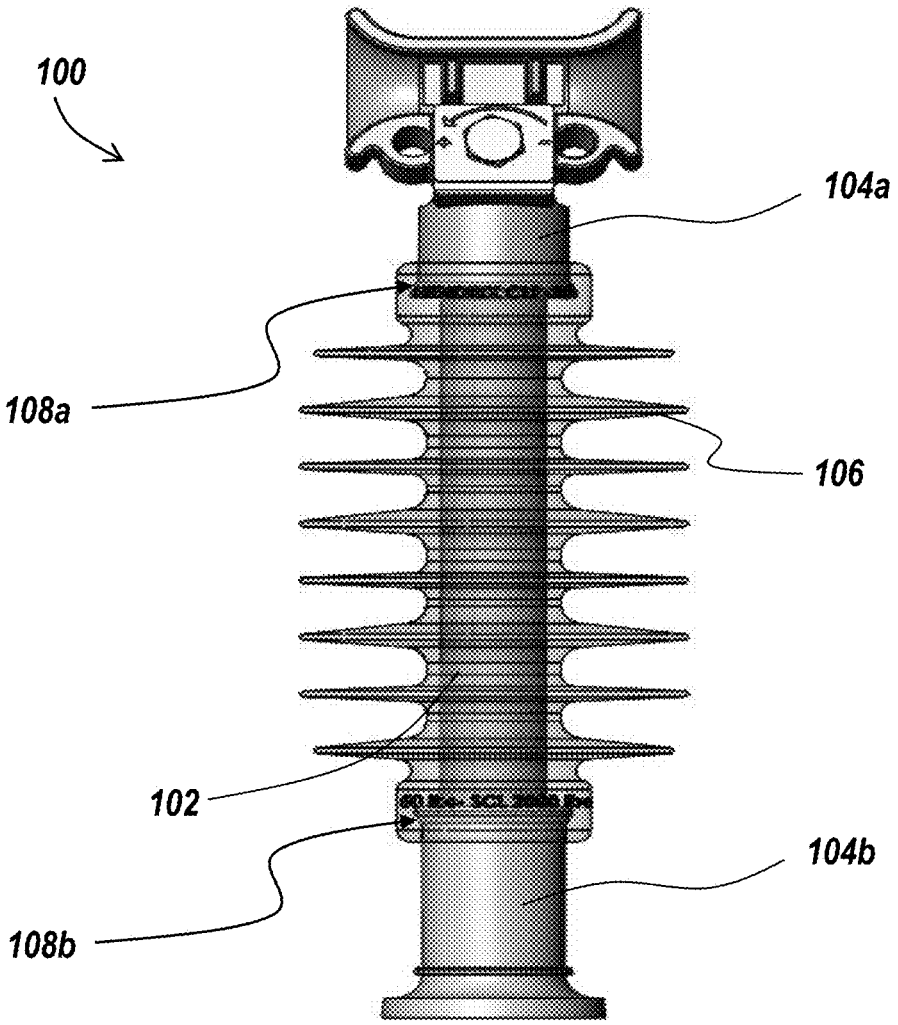
FIG. 2 illustrates an exemplary high voltage insulator configured in accordance with other embodiments of the subject disclosure.

FIG. 2 illustrates an exemplary high voltage insulator 100 in accordance with an alternative embodiment of the subject disclosure. FIG. 2 includes similar components as the high voltage insulator 100 of FIG. 1, including a core strength member 102, end fittings 104*a*, 104*b*, plastic body 106, and one or more elastomeric members 108*a*, 108*b* positioned between each end fitting 104*a*, 104*b* and the plastic body 106. However, the high voltage insulator 100 of FIG. 2 includes a different end fitting 104*a* than the end fitting 104*a* shown in the high voltage insulator 100 of FIG. 1.

Figure 3A:
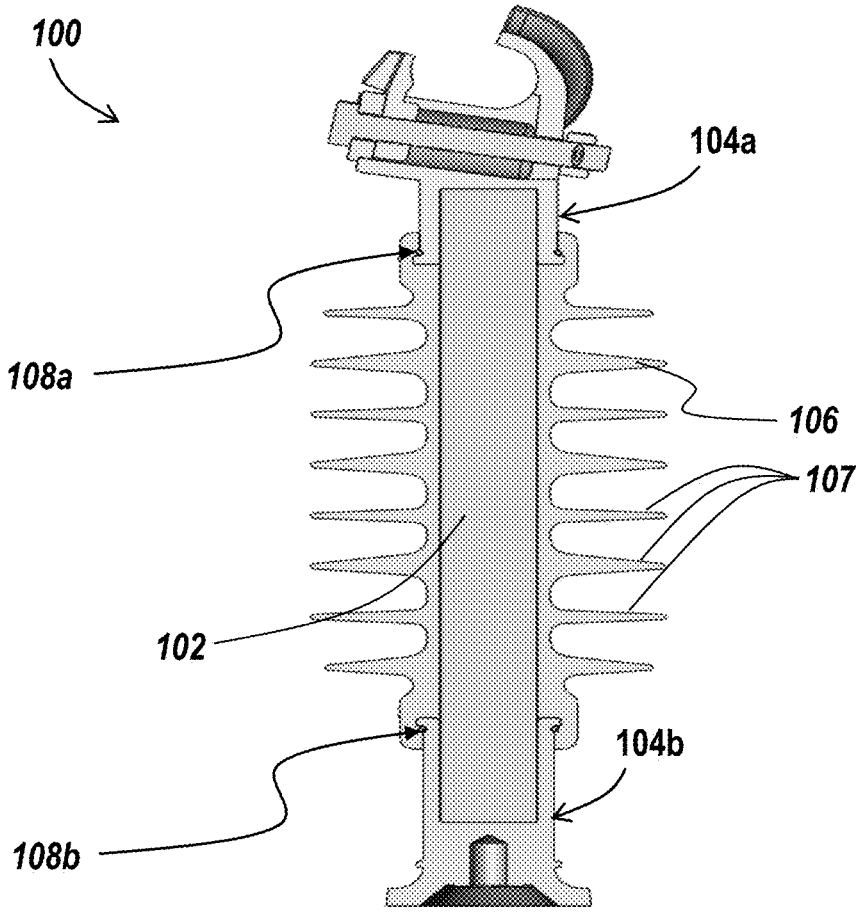
FIGS. 3A-3B illustrate cross-sectional views of an exemplary high voltage insulator configured in accordance with some embodiments of the subject disclosure. In particular.
Figure 3B:
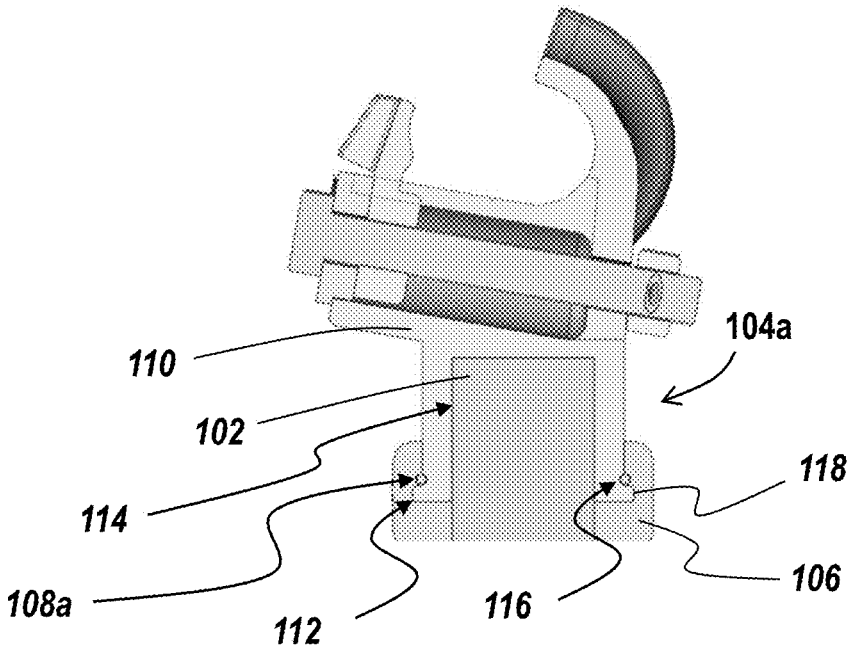
Figure 3C:
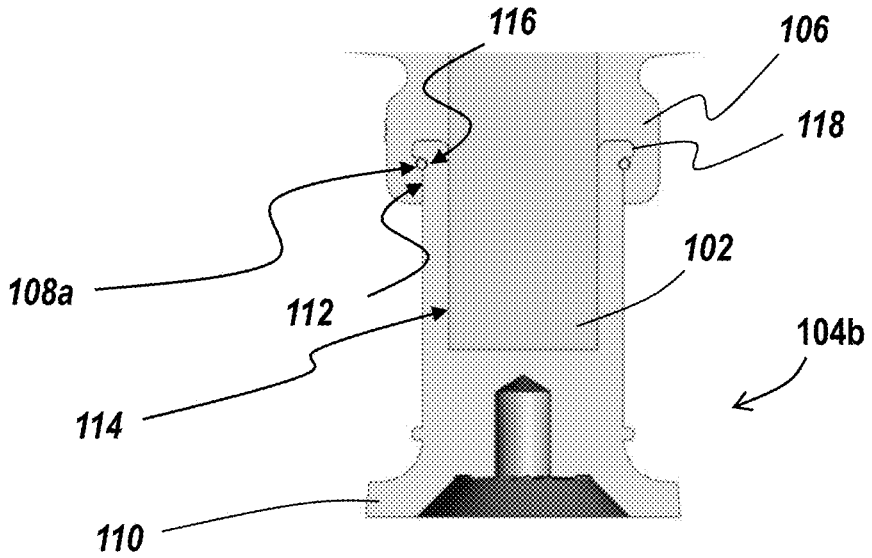
FIG. 3C illustrates the second end fitting of the high voltage insulator.

FIGS. 3A-3C illustrate cross-sectional views of an exemplary high voltage insulator 100. As shown in FIG. 3A, the high voltage insulator 100 includes a core strength member 102 connected to two end fittings 104*a*, 104*b* and a plastic body 106 surrounding the core strength member 102 and extending at least partially over features of the end fittings 104*a*, 104*b*. FIG. 3B illustrates a detailed view of the end fitting 104*a* illustrated in FIG. 3A and FIG. 3C illustrates a detailed view of the end fitting 104*b* shown in FIG. 3A. As shown in FIGS. 3B and 3C, the end fittings 104*a*, 104*b* each include a base 110 and a neck 112 positioned on opposing ends. The neck 112 includes an internal cavity 114 to receive and retain the core strength member 102. The base 110 may optionally include different connecting features (e.g., a single stud, NEMA type 4-hole pad, etc.) to join the insulator 100 to pole hardware, a metal bracket, or wood crossarm.

Figure 4A:
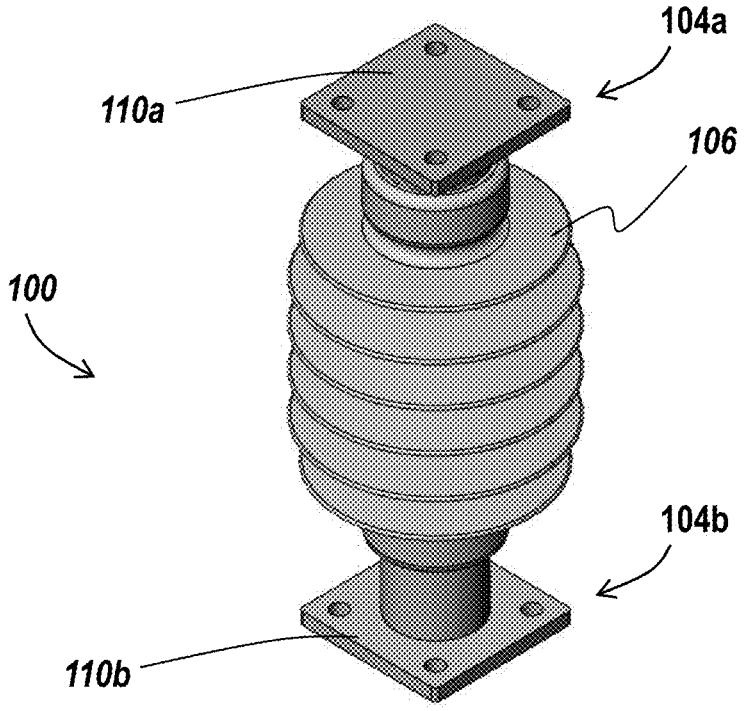
FIGS. 4A-4B illustrate an exemplary high voltage insulator for a substation, configured in accordance with some embodiments of the subject disclosure. In particular.
Figure 4B:
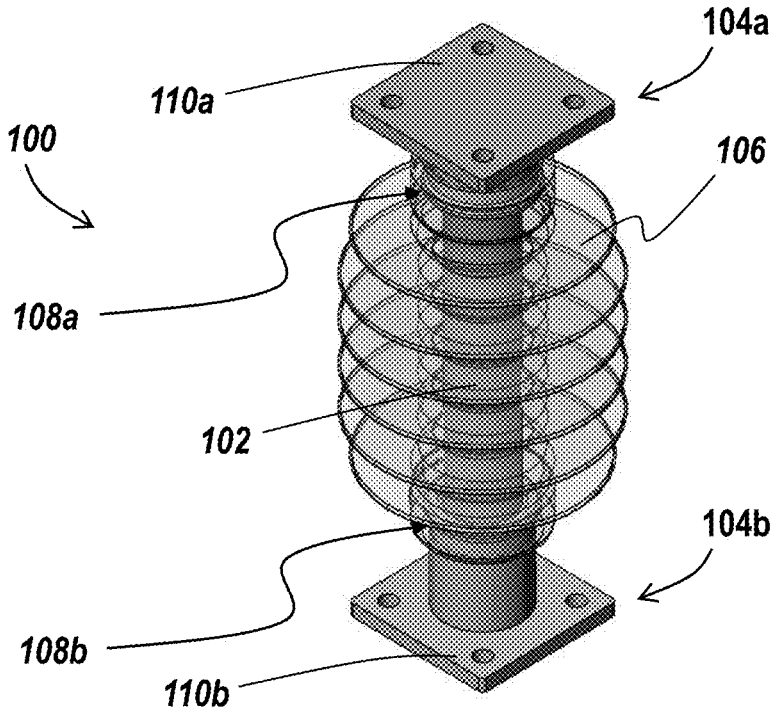

FIGS. 4A-4B illustrate an exemplary high voltage insulator 100 for a substation application. FIG. 4A illustrates a perspective view of the high voltage insulator 100 and FIG. 4B illustrates a view of the high voltage insulator 100 in which the plastic body 106 is transparent. As shown in FIGS. 4A and 4B, the end fittings 104*a*, 104*b* each include a base 110*a*, 110*b* having NEMA type 4-hole pads to secure the high voltage insulator 100 to the desired componentry (e.g., pole hardware, bracket, busbar, or crossarm). The high voltage insulator 100 shown in FIGS. 4A and 4B may have any features previously discussed with respect to the high voltage insulators shown in FIGS. 1, 2, and 3A-3C.

Figure 5A:
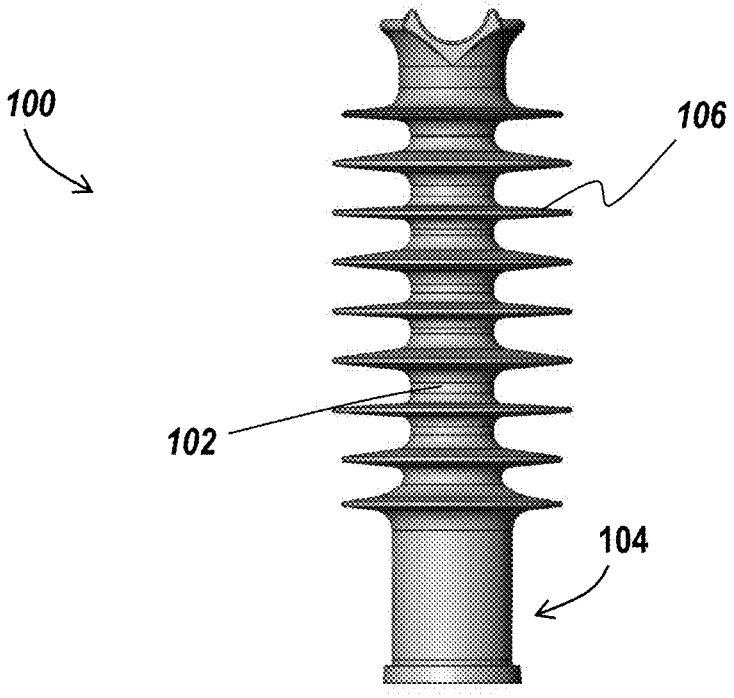
FIGS. 5A-5D illustrate an exemplary high voltage insulator configured in accordance with some embodiments of the subject disclosure. In particular.
Figure 5B:
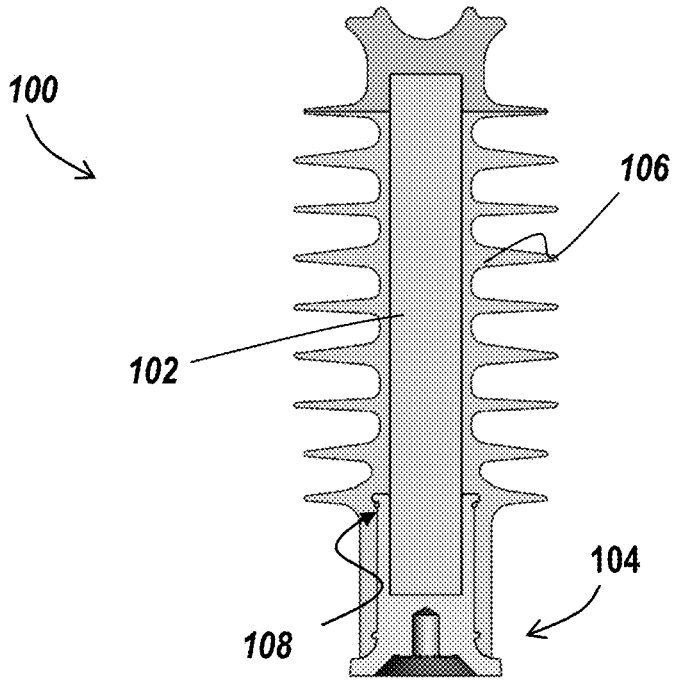
Figure 5C:
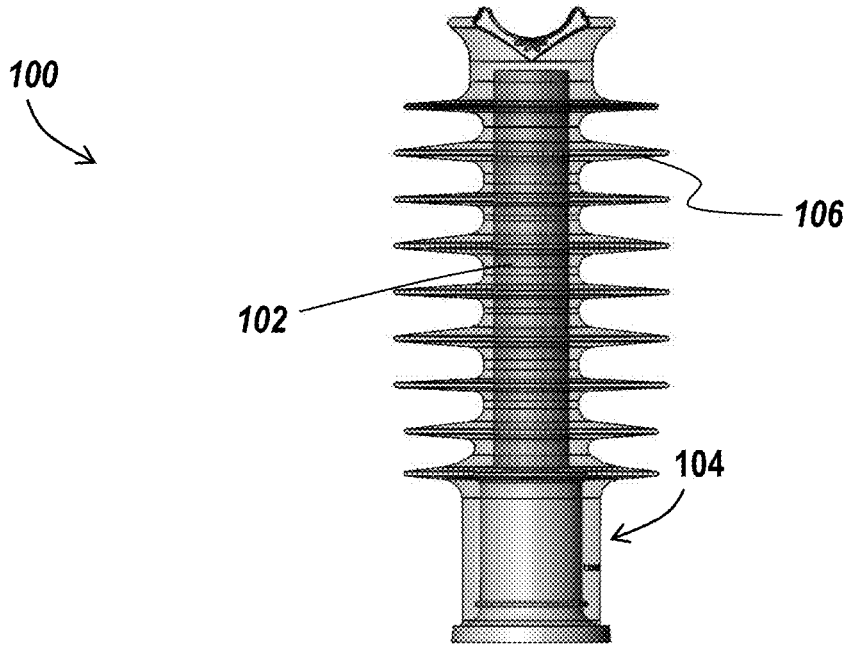
Figure 5D:
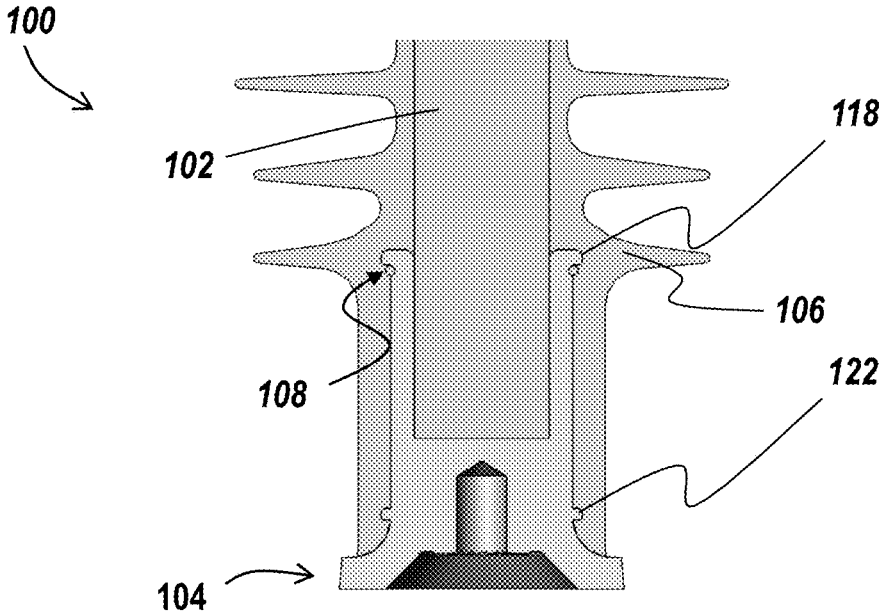

It should be noted that while in some embodiments two end fittings 104*a*, 104*b* are attached to opposing ends of the core strength member 102, in other embodiments, only one end fitting may be attached to the core strength member 102 (see, for example, the high voltage insulator 100 shown in FIGS. 5A-5D). In some such embodiments, the plastic housing 106 may be formed to cover the end of the core strength member 102 without an end fitting. As shown in FIGS. 5A-5D, the high voltage insulator 100 may include a single end fitting 104 having an underlying elastomeric member 108. The end fitting 104 may have any features previously discussed herein with respect to end fittings 104*a* and/or 104*b*. Similarly, the elastomeric member 108 may have any features previously described with respect to elastomeric members 108*a* and/or 108*b*. As shown in the cross-sectional view of the high voltage insulator 100 shown in FIG. 5D, the end fitting 104 may be formed to include features that protrude into the plastic housing 106 to ensure the end fitting 104 remains securely fastened thereto. For example, end fitting 104 may include a lip 118 on an outer surface to retain the elastomeric member 108 and/or a ridge 122 on an outer surface of the end fitting 104, as shown in FIG. 5D. Numerous configurations and variations are possible and within the scope of the subject disclosure.

In some embodiments, the end fitting(s) 104*a*, 104*b* may include structural features to retain the attached elastomeric member(s) 108*a*, 108*b*. For example, as shown in FIGS. 3B and 3C, the end fitting may include a channel 116 formed on an outer surface of the neck 112 sized to securely retain an elastomeric member 108*a*, 108*b*. In select embodiments, a lip 118 may be formed adjacent to the channel 116 to discourage migration of the elastomeric member as well as to ensure the plastic housing 106 remains secured to the end fitting 104*a*, 104*b*. As shown in FIGS. 3B and 3C, the lip 118 may be positioned farther from the base 110 than the channel 116, in some embodiments.

It is to be understood that the presently disclosed high voltage insulators are not limited to the particular embodiments illustrated in the accompanying drawings and described in detail here. Numerous alternative embodiments will be apparent to those skilled in the art upon consideration of the subject disclosure.

Exemplary Methods

Figure 6:
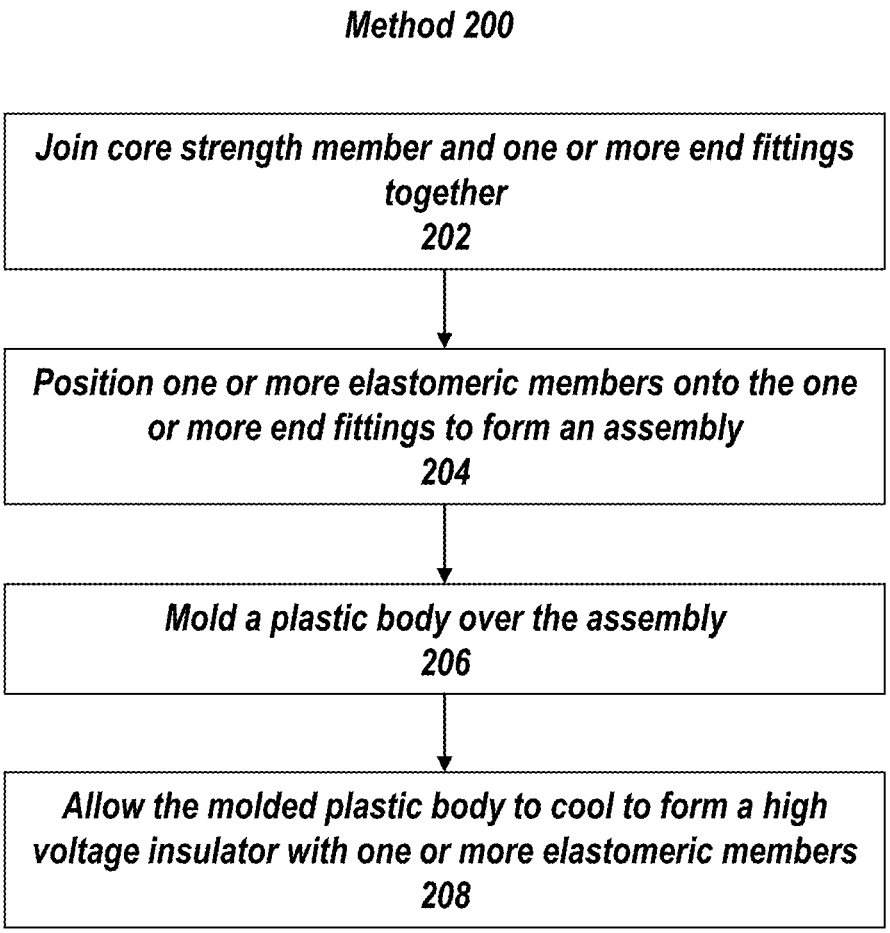
FIG. 6 illustrates an exemplary method of manufacturing a high voltage insulator in accordance with some embodiments of the subject disclosure.

FIG. 6 illustrates an exemplary method 200 of producing a high voltage insulator as described herein (i.e., having features previously discussed with respect to high voltage insulator 100). As shown in FIG. 6, method 200 includes joining a core strength member and one or more end fittings together (Block 202). As will be appreciated, the core strength member joined with the one or more end fittings may include any features described herein with respect to core strength member 102 and end fitting(s) 104*a*, 104*b*. Also, the core strength member may be joined to the one or more end fittings such that a portion of the core strength member extends partially into an internal cavity formed in the neck of the one or more end fittings.

Figure 7A:
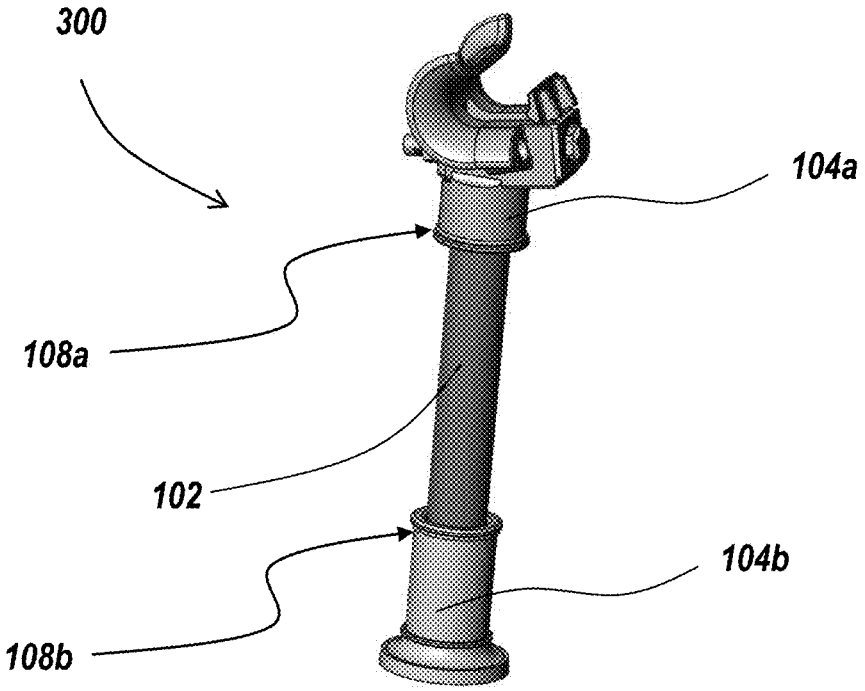
FIG. 7A illustrates an exemplary assembly formed during manufacturing of a high voltage insulator.

Method 200 continues with positioning one or more elastomeric members onto the one or more end fittings to form an assembly (Block 204). In some embodiments, the assembly is configured with an elastomeric member positioned in a channel on an outer surface of the neck of each end fitting present in the assembly. FIG. 7A illustrates an exemplary assembly 300 that includes a core strength member 102 with two end fittings 104*a*, 104*b* and two elastomeric members 108*a*, 108*b*.

Method 200 continues with molding a plastic body over the assembly (Block 206). As will be understood, the plastic body may be molded to have any features previously described herein with respect to plastic body 106. In some embodiments, the plastic body may be molded to cover the core strength member, the one or more elastomeric members, and at least a portion of the one or more end fittings.

Figure 7B:
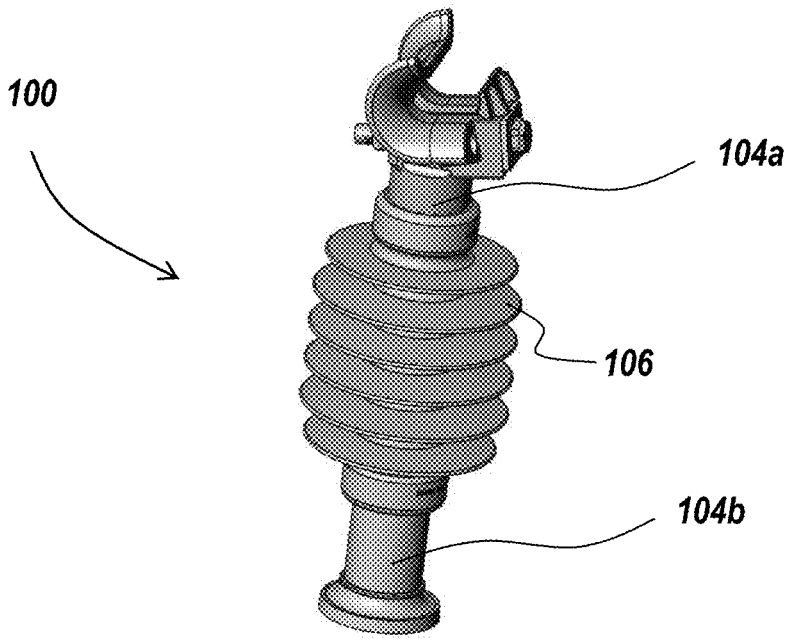
FIG. 7B illustrates an exemplary high voltage insulator formed after a plastic body is molded over the assembly illustrated in FIG. 7A.

After the plastic body is molded, it may be allowed to cool to form the high voltage insulator having one or more elastomeric members (Block 208). FIG. 7B illustrates an exemplary high voltage insulator 100 after the plastic body has been molded over the assembly 300 shown in FIG. 7A and the plastic body has been allowed to cool. In particular, FIG. 7B shows plastic body 106 after it has been molded over the core strength member 102 (shown in FIG. 7A), elastomeric members 108*a*, 108*b* (also shown in FIG. 7A) and at least portions of end fittings 104*a*, 104*b*.

Figure 7C:
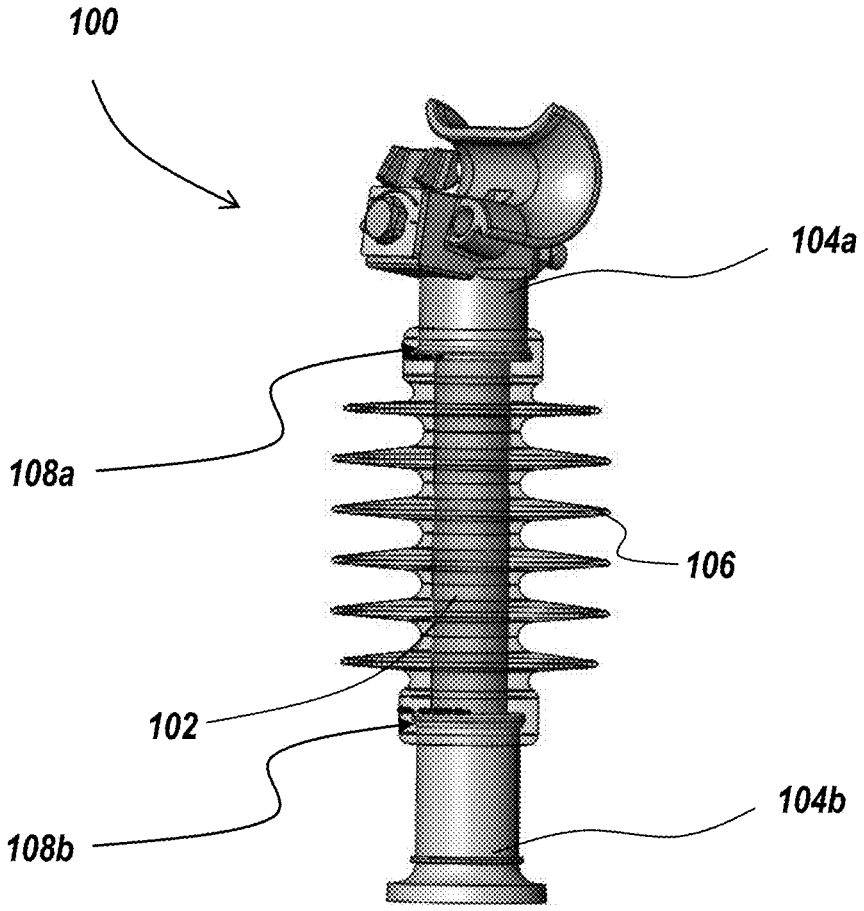
FIG. 7C illustrates a transparent view of the elements of the high voltage insulator shown in FIG. 7B.

The type of plastic used in method 200 may contract after it is molded and as it cools to radially compress the underlying elastomeric member(s). In some embodiments, the plastic body contracts at least 1%, 2%, 5%, or more as it cools to provide automatic compression of the underlying elastomeric member(s). Due to the automatic reduction in size of the plastic body upon cooling, the one or more elastomeric members of the high voltage insulator produced by method 200 are continuously radially compressed by the surrounding plastic body. FIG. 7C shows a see-through view of the high voltage insulator 100 shown in FIG. 7B. Specifically, in FIG. 7C, the plastic body 106 is shown as transparent so the underlying elastomeric members 108*a*, 108*b* and the core strength member 102 are visible.

While some exemplary embodiments of high voltage insulators embodying aspects of the subject disclosure have been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the disclosure as set forth in the appended claims.

What is claimed is:

1. A high voltage insulator comprising:

a rod-shaped core strength member;

at least one end fitting having a base and a neck with an internal cavity configured to retain a portion of the core strength member;

at least one elastomeric member positioned on an outer surface of the at least one end fitting;

a plastic body surrounding the core strength member, the at least one elastomeric member, and the neck of the at least one end fitting;

the neck including a channel formed in an outer surface of the end fitting to retain the elastomeric member; and a lip positioned next to the channel and farther away from the base than the channel, wherein the plastic body surrounds the channel, lip and elastomeric member, and wherein the plastic body exerts a radial compressive force on the at least one underlying elastomeric member.

2. The high voltage insulator of claim 1, wherein the core strength member is implemented with fiberglass.

3. The high voltage insulator of claim 1, wherein the plastic body is implemented with a thermoplastic.

4. The high voltage insulator of claim 3, wherein the thermoplastic is selected from the group consisting of: high density polyethylene (HDPE), linear low density polyethylene (LDPE), polypropylene, polyvinyl chloride (PVC), acrylonitrile butadiene styrene (ABS), acrylic (e.g., polymethyl methacrylate), polycarbonate, polyvinylidene fluoride (PVDF), and combinations thereof.

5. The high voltage insulator of claim 1, wherein the plastic body includes a plurality of fins.

6. The high voltage insulator of claim 5, wherein the fins are positioned parallel to one another.

7. The high voltage insulator of claim 1, wherein the one or more elastomeric members are formed of a material selected from the group consisting of: rubber, silicone, polybutadiene, isoprene, neoprene, polychloroprene, butyl rubber, fluorosilicone, ethylene-vinyl acetate (EVA), and combinations thereof.

8. The high voltage insulator of claim 1, wherein the one or more elastomeric members are toroidally shaped.

9. The high voltage insulator of claim 8, wherein the one or more elastomeric members each have a circular cross-section.

10. The high voltage insulator of claim 1, wherein the one or more end fittings are each formed of a metal.

11. The high voltage insulator of claim 1, wherein the high voltage insulator includes one end fitting and one elastomeric member.

12. The high voltage insulator of claim 1, wherein the high voltage insulator includes two end fittings and two elastomeric members.

13. A method of forming a high voltage insulator, the method comprising:

joining a core strength member and one or more end fittings together;

positioning one or more elastomeric members onto the one or more end fittings to form an assembly;

molding a plastic body over the assembly such that the plastic body covers the core strength member, the one or more elastomeric members, and at least a portion of the one or more end fittings; and allowing the molded plastic body to cool to form the high voltage insulator with one or more elastomeric members that are continuously radially compressed by the surrounding plastic body.

14. The method of claim 13, wherein the plastic body contracts at least 1% during cooling.

15. The method of claim 13, wherein the one or more elastomeric members are each positioned in a channel on an outer surface of the one or more end fittings.

* * * * *